United States Patent [19]

Beurskens et al.

[11] Patent Number: 4,633,127

[45] Date of Patent: Dec. 30, 1986

[54] ELECTRIC LAMP HAVING A STRONGLY COLORED LAMP ENVELOPE

[75] Inventors: Johannes H. H. Beurskens; Christiaan Prozeé, both of Weert, Netherlands

[73] Assignee: U.S. Philips Corp., New York, N.Y.

[21] Appl. No.: 573,548

[22] Filed: Jan. 25, 1984

[30] Foreign Application Priority Data

Feb. 10, 1983 [NL] Netherlands ..... 8300498

[51] Int. Cl.[4] ..... H01K 1/32; H01J 5/16

[52] U.S. Cl. ..... 313/112; 313/116; 313/113; 313/635

[58] Field of Search ..... 313/112, 116, 266, 635, 313/113; 350/311; 252/301.6 R; 427/28, 64, 106, 108

[56] References Cited

U.S. PATENT DOCUMENTS

| | | | |
|---|---|---|---|
| 2,995,463 | 8/1961 | Meister et al. | 313/116 |
| 3,125,457 | 3/1964 | Meister | 313/116 |
| 3,320,460 | 5/1967 | Bouchard et al. | 313/112 |
| 4,081,709 | 3/1978 | Collins et al. | 313/116 |
| 4,099,080 | 7/1978 | Dawson | 313/116 |
| 4,395,653 | 7/1983 | Graff | 313/116 |
| 4,441,046 | 4/1984 | James | 313/112 |
| 4,441,047 | 4/1984 | Collins | 313/116 |
| 4,499,397 | 2/1985 | James | 313/112 |

*Primary Examiner*—Jeanette Hunter

[57] ABSTRACT

The lamp envelope of the electric lamp is coated at the inner surface with an electrostatically applied light-scattering pigmented powder layer. The powder layer comprises at least a cadmium-containing pigment and further a cadmium-free pigment for example in approximately equal part by weight. Although cadmium-free pigments alone cannot give lamps the desired color properties, it has been found that they are capable of replacing cadmium-containing pigments in the powder layer up to a high percentage by weight.

4 Claims, 1 Drawing Figure

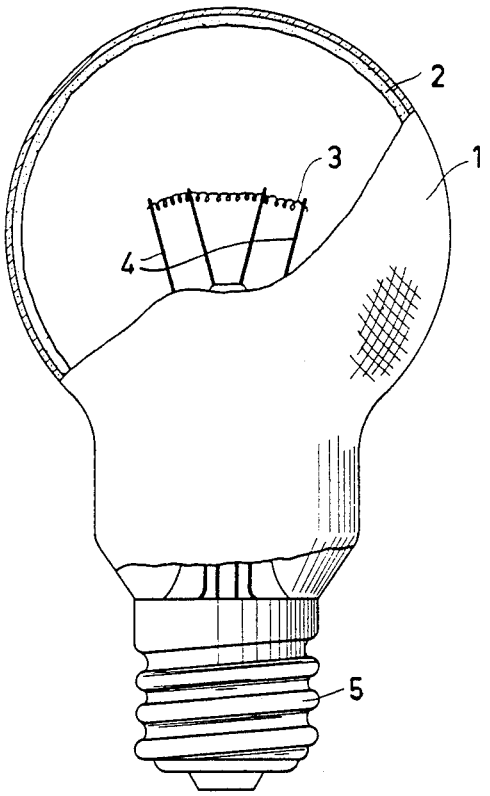
2
3
1
4
5

ELECTRIC LAMP HAVING A STRONGLY COLORED LAMP ENVELOPE

BACKGROUND OF THE INVENTION

The invention relates to an electric lamp provided with a glass lamp envelope which is sealed in a vacuum-tight manner and in which a light source is arranged, the lamp envelope being coated on its inner surface with an electrostatically applied light-scattering pigmented powder layer comprising at least one cadmium compound. An incandescent lamp of this kind is known from U.S. Pat. No. 3,320,460.

Such a lamp can be used in surroundings in which it has to be avoided that the light attracts insects, such as light sources for festive illumination, disco illumination, and the like.

Electrostatically applied powder layers have the advantage with respect to layers formed from a powder suspension that during the application no solvents and binders are introduced into the lamp envelope. In fact, the powder is dusted in a dry state in a lamp envelope whose wall is given a positive potential with respect to the powder. The powder adheres to the wall under the influence thereof.

An electrostatically applied powder layer has characteristic properties which distinguish the layer from a layer formed from a powder suspension. The layer has a very small packing density, which is even fifty times smaller than the packing density of a layer formed from a suspension of the same powder mixture. The layer has at its surface a very high degree of roughness as compared with a smooth surface of a layer obtained from a suspension. A remarkable difference is further that, when an electrostatically coated lamp envelope is observed along a tangent line of the lamp envelope, it is clearly visible that the wall of the lamp envelope has a certain thickness. On the contrary, with a lamp envelope coated by means of a suspension, the wall thickness of the lamp envelope, observed in the same manner, is not perceptible.

The requirement is imposed on colored lamps that in operation and out of operation they have the same color; that is, the color is the same for transmitted and incident light, respectively. The powder layer should scatter the light produced by the lamp in such a manner that the light source is not visible and the wall of the lamp envelope is illuminated uniformly.

It has been found that, especially when deep colors are desired, for several colors, such as red, yellow and colors formed therewith, such as orange, cadmium compounds have to be used as pigments. These compounds have a great coloring power, as a result of which they color the lamp intensely despite their being mixed with the light-scattering powder. Cadmium compounds moreover have a high thermal stability. However, cadmium compounds have the disadvantage of being toxic, which is the reason why it has to be avoided that at the end of the life of the lamps large quantities of these compounds ultimately show up in the environment.

SUMMARY OF THE INVENTION

The invention has for its object to provide a colored lamp in which the content of cadmium compounds is reduced while the desirable color properties of the lamp are maintained.

According to the invention, in a lamp of the kind described in the opening paragraph, this is achieved in that the powder layer further comprises as part of the pigment a cadmium-free compound.

It is a surprise to find that cadmium-free pigments which do not exhibit a sufficient coloring power to give lamps the same color both in operation and out of operation, and which are therefore not suitable to be used as the sole pigment in lamps, in fact are suitable to be used together with cadmium-containing pigments. It has been found that even when the cadmium pigment in a powder layer is replaced for a very large part by such a cadmium-free pigment or pigment mixture of the same color, a lamp is obtained which has comparable color properties. It has then proved possible to reduce the quantity of cadmium compound in a lamp by up to approximately 50 to 60%.

BRIEF DESCRIPTION OF THE DRAWING

An embodiment of the lamp according to the invention is shown in the drawing in side elevation, partly broken away.

DESCRIPTION OF THE PREFERRED EMBODIMENTS

In the FIGURE, the lamp envelope 1 has at its inner surface a pigmented light-scattering electrostatically applied coating 2, for example having the composition of the compound of Example 1 given below. A filament 3 is arranged in the lamp envelope as light source. Current-supply conductors 4 carry the light source 3 and extend through the wall of the lamp envelope 1 sealed in a vacuum-tight manner to the exterior, where they are secured to contacts of a lamp cap 5 secured to the lamp envelope.

In general, silicon dioxide or a mixture of silicon dioxides of different origin is used as the light-scattering component of the powder layer. This component generally has a primary particle size of mainly 10–30 nm. As examples of cadmium pigments can be mentioned: cadmium sulphide (yellow), and cadmium sulphoselenide (red), a mixture of these two compounds (orange), cadmium sulphide chromium-cobalt oxide (green).

Examples of cadmium-free pigments are: titanium-antimony-chromium oxide (yellow), nickel titanate (yellow), chromium titanate (yellow), cobalt-aluminium-titanium-nickel-zinc oxide (green), ferrioxide (red). The pigments generally have a primary particle size of mainly 100–5000 nm.

The powder for the powder layer can be mixed in the dry state, for example, in a fluidizing mixer. The desired resistivity of the powder mixture can be adjusted by using both a hydrophobic light-scattering material (having a resistivity of, for example, $10^{14}\ \Omega$) and a hydrophylic light-scattering material (having a resistivity of, for example, $10^{7}\ \Omega$), such as silicon dioxides. The light-scattering component of the powder ensures that the lamp envelope is illuminated uniformly by the light source, while the pigment provides for the desired color of the lamp envelope both with incident light and with transmitted light. The desired uniformity of the illumination of the lamp envelope on the one hand and the desired color of the lamp envelope on the other hand influence the ratio in which the pigments are mixed with the scattering component. In general a powder will be chosen in which the weight of the pigment amounts to 40–60% of the powder weight.

Generally, a filament, which may be included in an inner envelope, will be used as light source in the lamp according to the invention. Alternatives are, however, high-pressure gas discharges, such as high-pressure sodium and high-pressure mercury vapour discharges in an inner envelope.

Examples of the composition of powder layers of lamps according to the invention are, expressed in % by weight:

| | |
|---|---|
| 1. Cadmium sulphide | 20 |
| nickel titanate | 20 |
| hydrophobic $SiO_2$ | 20 |
| hydrophylic $SiO_2$ | 40. |
| 2. Cadmium sulphoselenide | 20 |
| iron oxide red | 20 |
| hydrophobic $SiO_2$ | 20 |
| hydrophylic $SiO_2$ | 40. |
| 3. Cadmium sulphide, cadmium sulphoselenide coprecipitate | 20 |
| chromium titanate | 20 |
| hydrophobic $SiO_2$ | 20 |
| hydrophylic $SiO_2$ | 40. |
| 4. cadmium sulphide, chromium cobalt oxide | 20 |
| Co, Al, Ti, Ni, Zn mixed oxide | 20 |
| hydrophobic $SiO_2$ | 20 |
| hydrophylic $SiO_2$ | 40. |

Lamp envelopes were coated electrostatically with these powders, by a process in which the lamp envelopes were given a positive potential of at least 12 kV with respect to the powder. The lamp envelopes were of the so-called A 60 type; that is, lamp envelopes with a spherical part and a neck-shaped part, of which the spherical part had a maximum diameter of 60 mm. The lamp envelopes were used for the manufacture of incandescent lamps, which consumed a power of 15, 25, 40 or 60 W at a voltage of 220 V.

For comparison, similar lamps were manufactured, which differed from those described in the preceding paragraph only in that (in a first series of lamps) solely the relevant cadmium compound was used as pigment up to a content of 40% by weight and (in a second series of lamps) solely the cadmium-free pigment was used.

The lamps were compared both in operation and out of operation as to their color and in operation as to the uniformity of the illumination of the lamp envelope. With respect to the uniformity, just as with respect to the color in operation (transmitted light), the lamps were equivalent. With incident light, the lamps of the second comparison series were distinctly of poorer quality. They had a pale and distinctly different color from that in operation. The lamps according to the invention and those of the first comparison series had the same color with incident light. In lamps according to the invention, the cadmium content, however, was reduced by half with respect to this content in lamps using solely cadmium compound as pigment.

What is claimed is:

1. An electric lamp having the same apparent color under incident as with transmitted light, comprising a glass lamp envelope sealed in a vacuum-tight manner, a light source arranged within said envelope, and a light-scattering pigmented powder layer, comprising at least one cadmium compound, electrostatically applied to the inner surface of said envelope, characterized in that said powder layer further comprises as an effective part of the pigment a cadmium-free compound which has the same color as said cadmium compound, and which has insufficient coloring power by itself to produce the same color for incident as for transmitted light.

2. A lamp as claimed in claim 1, characterized in that said cadmium-free pigment compound constitutes approximately 20% by weight of said powder layer.

3. A lamp as claimed in claim 1, comprising an amount by weight of said cadmium-free pigment compound as least equal to the amount by weight of said cadmium compound.

4. A lamp as claimed in claim 1, characterized in that said cadmium-free compound and said cadmium compound each constitute approximately 20% by weight of said powder layer.

* * * * *